United States Patent [19]

Fisher et al.

[11] 4,089,736

[45] May 16, 1978

[54] METHOD OF REMOVING AL-CR-CO COATINGS FROM NICKEL ALLOY SUBSTRATES

[75] Inventors: Maurice Fisher; Terence Walter Maber, both of Bristol; Colin Garry Lilly, Westion-Super-Mare, all of England

[73] Assignee: Rolls-Royce Limited, London, England

[21] Appl. No.: 786,555

[22] Filed: Apr. 11, 1977

[30] Foreign Application Priority Data

Apr. 27, 1976 United Kingdom ..... 16976/76

[51] Int. Cl.[2] ..... C23F 1/00

[52] U.S. Cl. ..... 156/665; 252/79.2

[58] Field of Search ..... 156/656, 664, 665; 252/79.1, 79.2; 75/104, 111, 110

[56] References Cited

U.S. PATENT DOCUMENTS

| | | | |
|---|---|---|---|
| 3,663,441 | 5/1972 | Gulla | 156/665 |
| 3,689,417 | 9/1972 | Oikawa et al. | 156/665 |
| 4,032,359 | 6/1977 | Fisher et al. | 156/665 |

*Primary Examiner*—David Klein
*Assistant Examiner*—Jerome W. Massie
*Attorney, Agent, or Firm*—Stevens, Davis, Miller & Mosher

[57] ABSTRACT

A method of removing a coating containing aluminium and chromium in combination with cobalt from a nickel base alloy substrate. The coated substrate is immersed in a solution containing the following constituents (by weight):

Ferric Sulphate; 6–14%
Hydrochloric Acid; 3.5–11%
Water; Remainder

When substantially all of the coating has been dissolved, the substrate is removed from the solution.

5 Claims, No Drawings

METHOD OF REMOVING AL-CR-CO COATINGS FROM NICKEL ALLOY SUBSTRATES

This invention relates to a method of and mixture for the removal of aluminium-chromium-cobalt-containing alloy coatings from nickel base alloy substrates.

In order to enhance their resistance to corrosion nickel base alloy substrates are often coated with a thin layer of an alloy containing aluminium and chromium in combination with cobalt. Such coatings are applied by the techniques of vacuum deposition or plasma spraying and are commonly 100 to 150 microns thick. If coatings of this type are damaged, it is usually necessary to remove the whole of the remaining coating from the substrate before a fresh coating may be applied. This is essential if the coated substrate is, for example, in the form of an aerofoil blade for a gas turbine propulsion engine. Such blades sre manufactured to an extremely high degree of accuracy and consequently any surface dis-continuities cannot be tolerated. It is also sometimes necessary to remove a coating of this type from a substrate if it is desired to inspect the substrate for small cracks etc. which may be hidden by the coating.

There are two main methods by means of which such coatings may be removed: mechanical abrasion and chemical dissolution. Mechanical abrasion is not a particularly effective method since it is long and often results in the substrate being abraded to such an extent that it cannot be successfully recoated. Chemical dissolution is a more attractive method in that it is extremely effective in the removal of coatings from inaccessible substrate regions. However, it is difficult to achieve dissolution of the coating without significant substrate attack. Substrate attack can be minimised by the use of inhibited hydrochloric acid for coating removal. Unfortunately, the rate of coating attack by hydrochloric acid is slow unless high temperatures are utilized. However, at such high temperatures there is a tendency for substrate attack to occur and the hydrochloric acid has to be of such a concentration that elaborate fume extraction techniques must be employed.

It is an object of the present invention to provide a method of and mixture for the removal of a coating comprising aluminium and chromium in combination with cobalt from a nickel base alloy substrate whereby minimal attack of the substrate and an acceptable coating removal rate are achieved.

According to one aspect of the present invention a method of removing a coating containing aluminium and chromium in combination with cobalt from a nickel base alloy substrate comprises immersing the coated substrate in a solution containing the following constitutents (by weight):

Ferric Sulphate — 6–14%
Hydrochloric Acid — 3.5–11%
Water — Remainder until substantially all of the coating has been dissolved and then removing the substrate from the solution.

We have found that if the ferric sulphate content of the solution falls below 6% by weight, the coating dissolution rate becomes undesirably slow and indeed dissolution may not even commence. If the ferric sulphate level is above 14% by weight, there is a tendency for substrate attack to occur. The preferred ferric sulphate content range is between 8 and 10% by weight.

Similarly we have found that if the hydrochloric acid content of the solution falls below 3.5% by weight, the coating dissolution rate becomes undesirably slow and if it is above 11% by weight, substrate attack occurs. The preferred hydrochloric acid content range is between 7 and 9% by weight.

The temperature of the etching solution may be maintained at between 15° and 75° C. However we prefer to maintain the temperature within the range 45° to 55° C.

An example of the method according to this invention will now be described. The component substrate was a nickel-base heat-resisting alloy consisting of (by weight):

Cobalt 14.5 – 16%
Molybdenum 2.7 – 3.5%
Aluminium 5.0 – 5.9%
Titanium 4.7 – 5.6%
Chromium 9.5 – 10.5%
Nickel Remainder The coating was a cobalt-chromium-aluminium alloy consisting approximately of (by weight):

Chromium; 25%
Aluminium; 10%
Yttrium; 0.5%
Cobalt; Remainder

The coating was applied by vacuum deposition and had a thickness of 100–150 micron. The component was a turbine blade of a gas turbine engine and the coating had to be stripped, i.e. removed, due to damage thereto in use and prior to inspection of the substrate and application of a fresh coating.

The method of stripping comprised the following steps:

1. Degrease the blades in trichloroethylene vapor.
2. Mask the roots and shrouds of the blade with adhesive tape.
3. Abrasive blast the aerofoil surfaces, i.e. the surfaces to be stripped, with 120/220 alumina grit.
4. Remove masking tape and blow off dust with clean compressed air.
5. Mask the roots and shrouds with acid resistant ICI red lacquer F230–2006 and leave to dry for 30 minutes minimum.
6. Load the blades into a perforated, plastic container, preferably with the blades in the vertical position.
7. Immerse the perforated basket of blades in the stripping solution described below for one hour. One liter of solution is sufficient for the removal of 0.04 sq. meters of coating.

Stripping Solution

Ferric Sulphate 10% by weight
Hydrochloric Acid 7.2% by weight
Water Remainder contained in a plastic or glass tank and maintained at 50° C.

8. Remove the container of blades from the stripping solution, allow to drain, then wash in cold, running water, brushing with a soft bristle brush to remove any reaction-inhibiting layer which may have formed on the blade surface.
9. Load the blades again as in 6, then immerse in fresh stripping solution as in 7 for the period of one hour, then wash and brush as in 8.
10. Examine the blades to ensure that the coating has been stripped, in which case the grain structure of the substrate material will be visible. If the coating has not been fully stripped, repeat the cycle as in 9, (or mechanically polish at a later stage to remove traces of coating).

11. When the coating has been fully stripped, wash the blades thoroughly in cold running water.

12. Rinse the blades in clean hot water and blow dry with clean compressed air.

13. Remove the lacquer in a suitable solvent such as trichloroethylene liquid.

14. Immerse the blades in cold water to which a little ammonia solution may be added to neutralize acid residues and allow to soak overnight.

15. Rinse the blades in cold running water, then rinse in clean hot water and blow dry with clean compressed air.

We claim:

1. A method of removing a coating from a substrate, said coating containing aluminium and chromium in combination with cobalt, said substrate being a nickel base alloy, said method comprising immersing said coated substrate in a solution containing the following constituents (by weight):

Ferric Sulphate; 6–14%
Hydrochloric Acid; 3.5–11%
Water; Remainder until substantially all of the coating has been dissolved and then removing the substrate from the solution.

2. A method of removing a coating from a substrate as claimed in claim 1 wherein said solution contains 8–10% by weight ferric sulphate.

3. A method of removing a coating from a substrate as claimed in claim 1 wherein said solution contains 7–9% by weight hydrochloric acid.

4. A method of removing a coating from a substrate as claimed in claim 1 wherein said solution is maintained at a temperature between 15° and 75° C.

5. A method of removing a coating from a substrate as claimed in claim 4 wherein said solution is maintained at a temperature between 45° and 55° C.

* * * * *